US010273718B2

(12) United States Patent
Cannella

(10) Patent No.: US 10,273,718 B2
(45) **Date of Patent: *Apr. 30, 2019**

(54) KEYLESS LOCKING SYSTEM

(71) Applicant: Thomas B. Cannella, Clearwater, FL (US)

(72) Inventor: Thomas B. Cannella, Clearwater, FL (US)

(73) Assignee: DEE CEE MARKETING, INC., St. Petersburg, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/138,980

(22) Filed: Sep. 22, 2018

(65) Prior Publication Data

US 2019/0024411 A1 Jan. 24, 2019

Related U.S. Application Data

(63) Continuation of application No. 15/597,697, filed on May 17, 2017, now Pat. No. 10,087,656.

(51) Int. Cl.
*E05B 47/00* (2006.01)
*E05B 63/00* (2006.01)

(52) U.S. Cl.
CPC ..... *E05B 47/0012* (2013.01); *E05B 63/0004* (2013.01); *E05B 2047/002* (2013.01); *E05B 2047/0083* (2013.01); *E05B 2047/0091* (2013.01); *E05B 2047/0094* (2013.01)

(58) Field of Classification Search
CPC ..... E05B 47/0012; E05B 63/0004; E05B 2047/0091; E05B 2047/002; E05B 2047/0005; E05B 2047/0017; E05B 47/0038; E05B 47/02; E05B 2047/0095; E05B 2047/0084; E05B 47/00; E05B 63/00; E05B 2047/0083; E05B 2047/0094
USPC ..... 70/276, 408, 456 R, 278.1, 278.3, 256, 70/257, 277, 278.7, 279.1, 280–282; 292/141, 142, 144, 251.5
See application file for complete search history.

(56) References Cited

U.S. PATENT DOCUMENTS 2,879,725 A * 3/1959 Zuver ..... E05B 65/0075 109/39
3,600,025 A * 8/1971 Brainard ..... E05C 19/165 292/251.5
3,829,138 A * 8/1974 Morita ..... E05B 63/248 292/254

(Continued)

*Primary Examiner* — Lloyd A Gall
(74) *Attorney, Agent, or Firm* — Lewellyn Law, PLLC; Stephen Lewellyn

(57) ABSTRACT

A keyless locking system for a door having an existing rotatable deadbolt. The keyless locking system has a housing, a drive train sub-assembly disposed within the housing, the drive train sub-assembly having a motor, and a power-transfer sub-assembly disposed within the housing, the power transfer sub-assembly having an actuator made of an elastomeric material and a C-channel shaped element configured to for positioning over the existing rotatable deadbolt when the housing is coupled to the door. The motor is operatively connected to the actuator to rotate the actuator and the actuator is operatively connected to the C-channel shaped element to rotate the C-channel shaped element. Rotational motive force of the motor is transferred from the actuator to the C-channel shaped element.

9 Claims, 5 Drawing Sheets

(56) References Cited

U.S. PATENT DOCUMENTS 3,875,772 A * 4/1975 Ebersman ..... E05B 53/003 292/38
4,438,962 A * 3/1984 Soloviff ..... E05B 47/0012 292/144
4,557,124 A * 12/1985 Russ ..... H01M 2/1055 70/456 R
4,593,543 A * 6/1986 Stefanek ..... E05B 47/0002 292/144
4,821,652 A * 4/1989 Hoffman ..... E05G 1/00 109/23
5,678,436 A * 10/1997 Alexander ..... E05B 47/0012 70/256
5,704,235 A * 1/1998 Stahle ..... A45C 11/324 206/37.1
5,896,769 A * 4/1999 Elpern ..... E05B 47/0012 70/279.1
5,987,818 A * 11/1999 Dabideen ..... E05B 17/0029 292/144
5,997,054 A * 12/1999 Baudu ..... F02K 1/76 292/201
6,216,502 B1 * 4/2001 Cannella ..... E05B 47/0012 292/142
6,591,643 B1 * 7/2003 Cannella ..... E05B 47/0012 292/142
6,742,369 B1 * 6/2004 Veillette ..... E05B 13/002 292/288
7,373,795 B2 * 5/2008 Kilbourne ..... E05B 47/0012 292/244
8,869,574 B2 * 10/2014 Schmidt-Lackner ..... E05B 17/147 292/244
9,133,651 B2 * 9/2015 Trinh ..... E05B 65/46
9,267,583 B2 * 2/2016 Narovlansky ..... E05B 47/0012
9,476,232 B1 * 10/2016 Verdecia ..... E05B 19/00
9,982,461 B1 * 5/2018 Kilbourne ..... E05B 47/0012
10,087,656 B1 * 10/2018 Cannella ..... E05B 47/0012
2008/0296912 A1 * 12/2008 Whitner ..... E05B 47/0012 292/144
2009/0084147 A1 * 4/2009 Mizutani ..... E05B 9/02 70/277
2014/0260447 A1 * 9/2014 Schmidt-Lackner ..... E05B 47/068 70/262
2016/0040452 A1 * 2/2016 Ku ..... E05B 47/0012 292/336.3
2017/0002585 A1 * 1/2017 Ku ..... E05B 47/02
2017/0002586 A1 * 1/2017 Lee ..... E05B 47/0012

* cited by examiner

FIG. 6
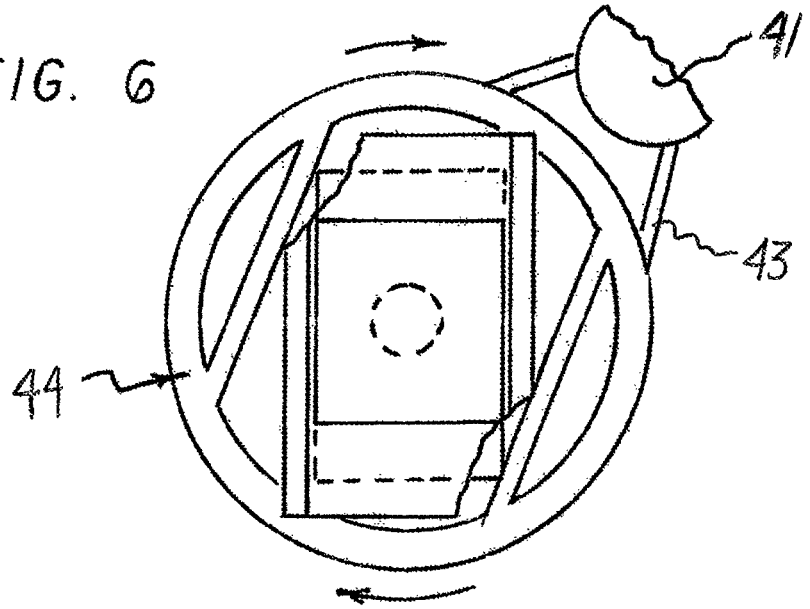
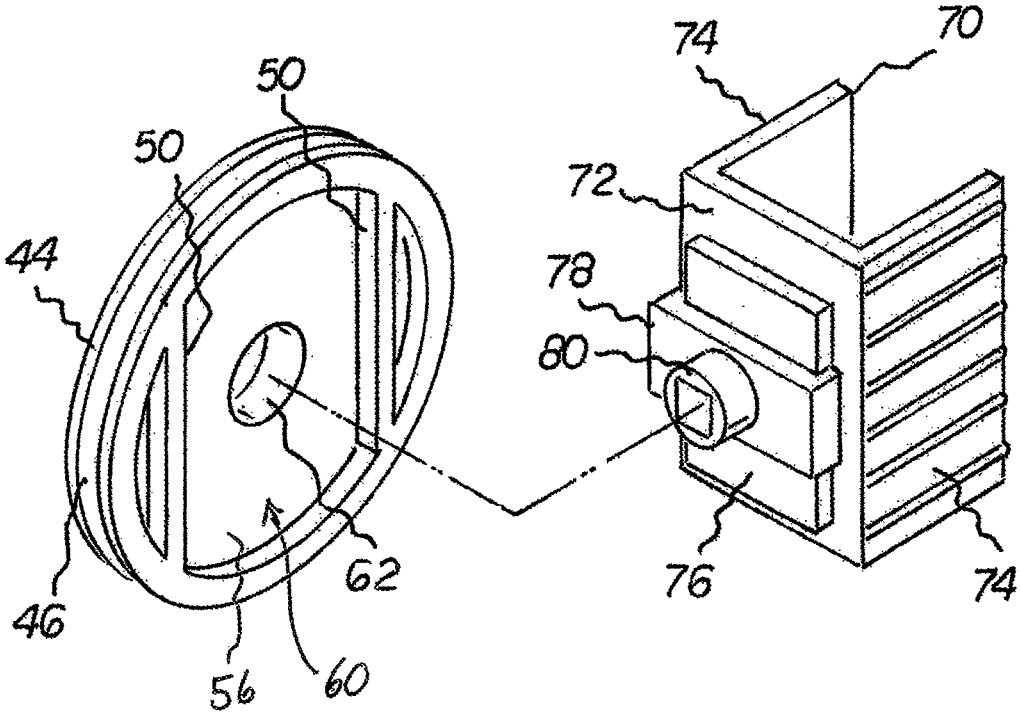
FIG. 7

KEYLESS LOCKING SYSTEM

CROSS-REFERENCE TO RELATED APPLICATIONS

This application is a continuation of U.S. application Ser. No. 15/597,697, filed May 17, 2017, now U.S. Pat. No. 10,087,656 entitled Keyless Locking System, the entirety of which is incorporated herein by reference.

FIELD OF THE INVENTION

The present invention relates to a keyless locking system and more particularly pertains to confidently locking and unlocking an existing deadbolt of a door from a remote location.

DESCRIPTION OF THE PRIOR ART

The present application is an improvement over prior application Ser. No. 09/542,298 filed Apr. 4, 2000 and issued Apr. 7, 2001 as U.S. Pat. No. 6,216,502, the subject matter of which is incorporated herein by reference.

The use of locking systems of known designs and configurations is known in the prior art. More specifically, locking system of known designs and configurations previously devised and utilized for the purpose of locking and unlocking doors through known methods and apparatuses are known to consist basically of similar, expected, and obvious structural configurations, notwithstanding the myriad of designs encompassed by the crowded prior art which has been developed for the fulfillment of countless objectives and requirements.

By way of example, U.S. Pat. No. 3,829,138 to Morita discloses a remotely controlled latch system for fire doors and the like. U.S. Pat. No. 4,593,543 to Stefanek discloses a security lock. U.S. Pat. No. 5,896,769 to Elpern et al. discloses an electrically operated actuator. Lastly, U.S. Pat. No. 5,987,818 to Dabideen discloses a remotely controlled door locking and opening system.

While these devices fulfill their respective, particular objectives and requirements, the aforementioned patents do not describe a keyless locking system that allows confidently locking and unlocking an existing deadbolt of a door from a remote location.

In this respect, the keyless locking system according to the present invention substantially departs from the conventional concepts and designs of the prior art, and in doing so provides an apparatus primarily developed for the purpose of confidently locking and unlocking an existing deadbolt of a door from a remote location.

Therefore, it can be appreciated that there exists a continuing need for a new and improved keyless locking system which can be used for confidently locking and unlocking an existing deadbolt of a door from a remote location. In this regard, the present invention substantially fulfills this need.

SUMMARY OF THE INVENTION

In view of the disadvantages inherent in the known types of locks now present in the prior art, the present invention provides an improved keyless locking system. As such, the general purpose of the present invention, which will be described subsequently in greater detail, is to provide a new and improved keyless locking system and method which has all the advantages of the prior art and none of the disadvantages.

To attain this, from a broad perspective, the present invention essentially comprises a keyless locking system. Such system includes a housing having a front plate and a rear plate and a periphery there between thereby forming a chamber. A plurality of magnets removably couple the housing to a door. The door has an exterior surface with a rotatable existing deadbolt. A drive train sub-assembly with a motor is within the chamber. A power transfer sub-assembly is also within the chamber. The power transfer subassembly includes an elastomeric component and a C-channel positionable over the existing deadbolt. The power transfer sub-assembly is powered by the drive train sub-assembly. A control member is adapted to power the motor to rotate the C-channel and the existing deadbolt.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved keyless locking system which has all of the advantages of the prior art locks and none of the disadvantages.

It is another object of the present invention to provide a new and improved keyless locking system which may be easily and efficiently manufactured and marketed.

An even further object of the present invention is to provide a new and improved keyless locking system which is susceptible of a low cost of manufacture with regard to both materials and labor, and which accordingly is then susceptible of low prices of sale to the consuming public, thereby making such keyless locking system economically available to the buying public.

Lastly, it is an object of the present invention to provide a keyless locking system for conveniently locking and unlocking an existing deadbolt on an interior surface of a door. These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 6 is a rear elevational view of the interface between the drive train sub-assembly and the power transfer sub-assembly.

FIG. 7 is an exploded perspective illustration of the interface between the drive train sub-assembly and the power transfer sub-assembly.

The same reference numerals refer to the same parts throughout the various Figures of the primary and alternate embodiment.

DESCRIPTION OF THE PREFERRED EMBODIMENT

Figure 1:
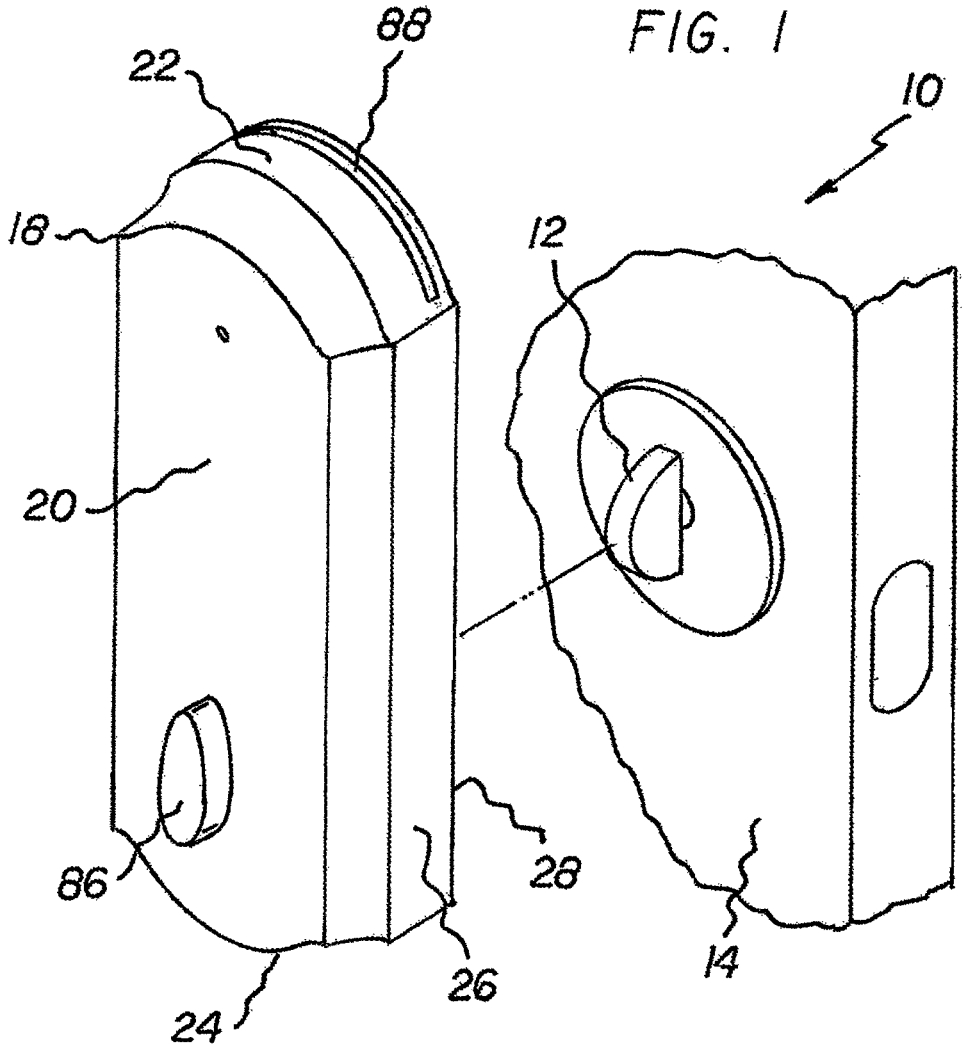
FIG. 1 is an exploded perspective illustration of a keyless locking system constructed in accordance with the principles of the present invention.
Figure 1:
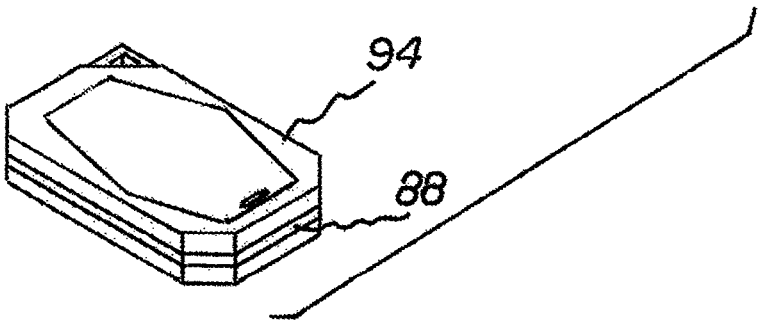
Figure 2:
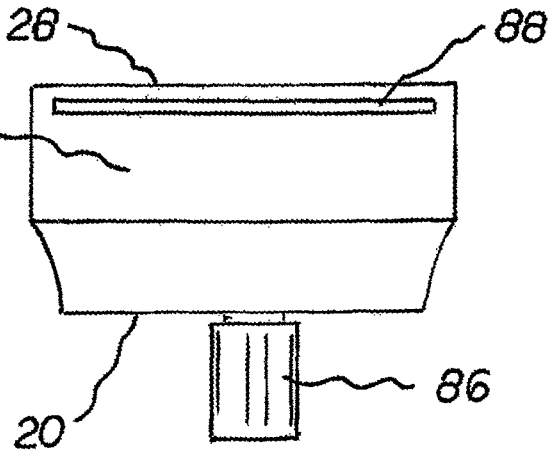
FIG. 2 is a plan view of the system shown in FIG. 1.
Figure 3:
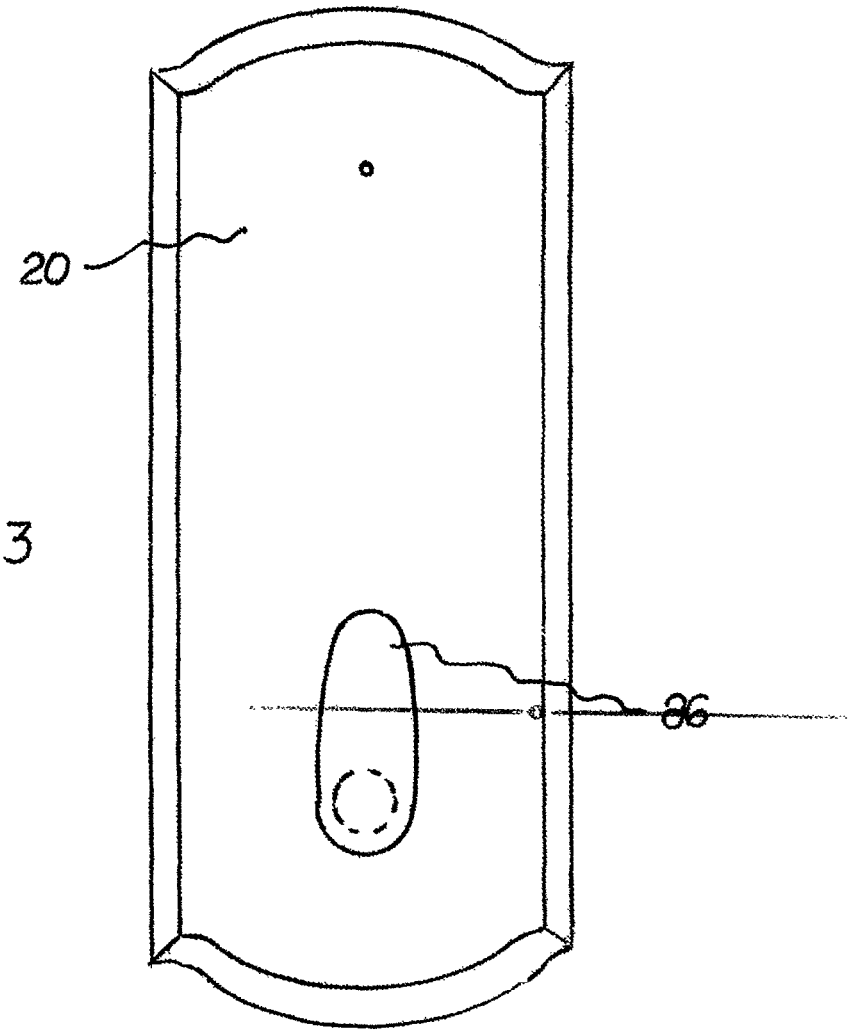
FIG. 3 is a front elevational view of the system shown in FIGS. 1 and 2.
Figure 4:
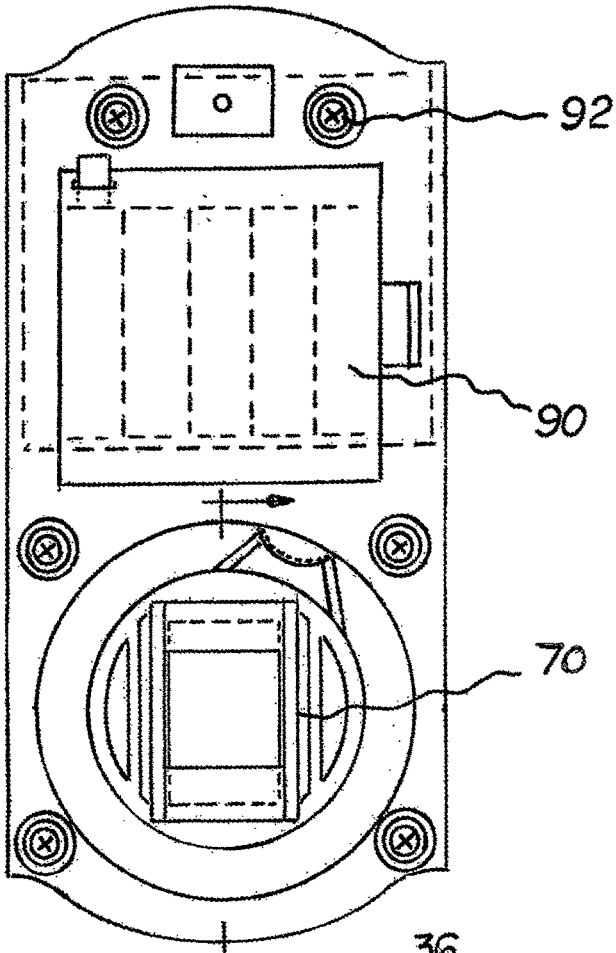
FIG. 4 is a rear elevational view of the housing shown in the prior Figures.
Figure 5:
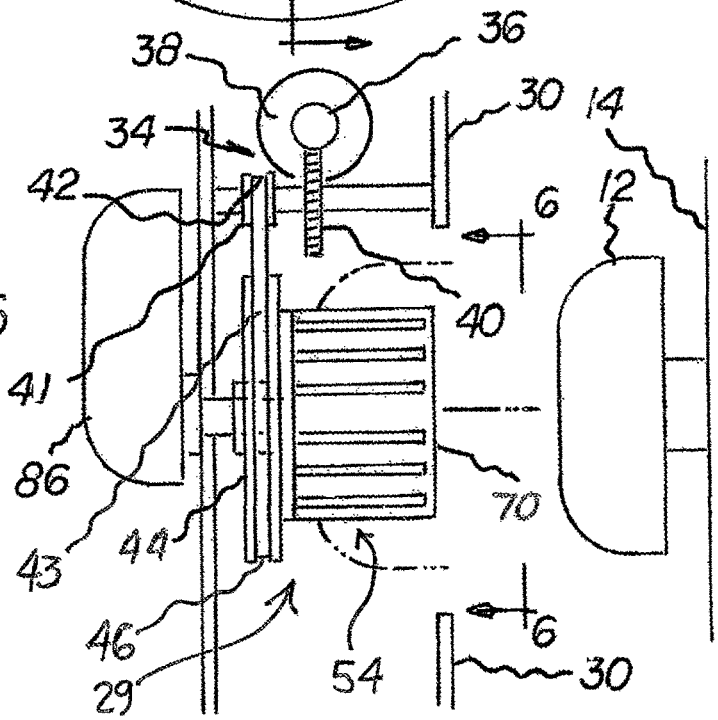
FIG. 5 is a side elevational view of the housing shown in the prior Figures.
Figure 8:
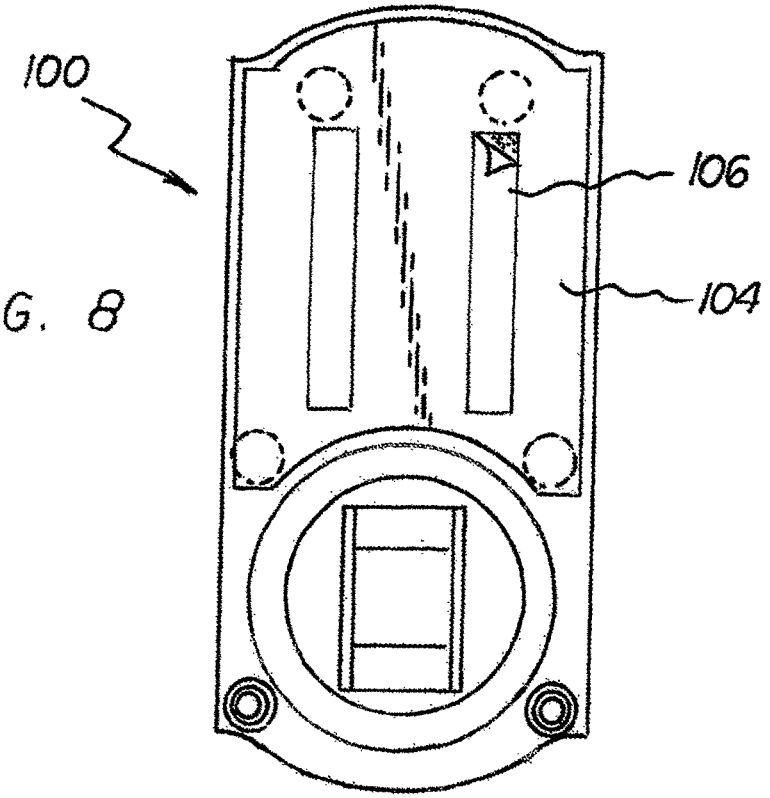
FIG. 8 is a rear elevational view similar to FIG. 4 but illustrating an alternate embodiment of the present invention, such alternate embodiment being for use with non-metal doors.
Figure 9:
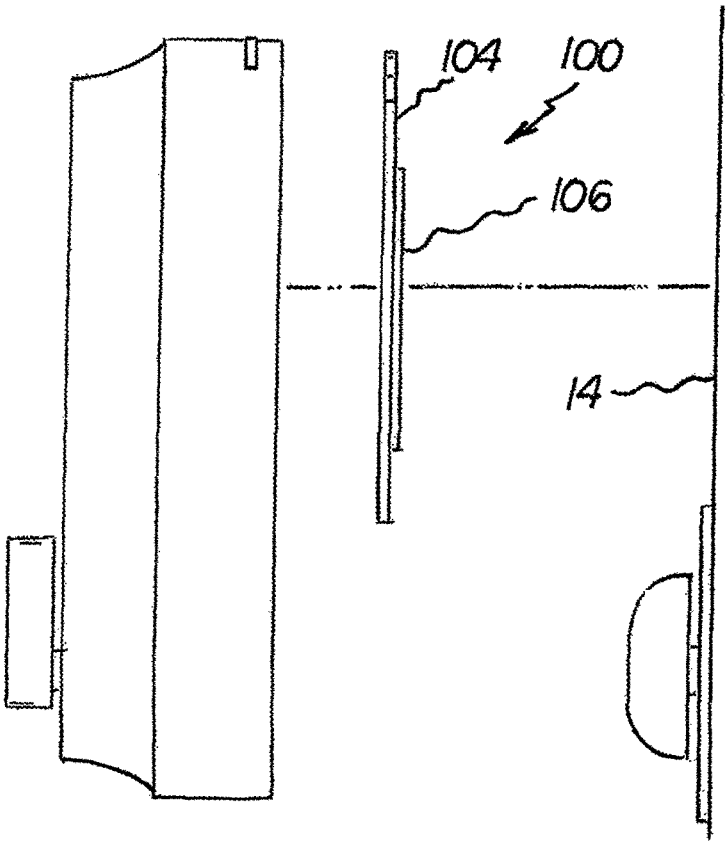
FIG. 9 is an exploded side elevational view of the alternate embodiment of FIG. 8.

With reference now to the drawings, and in particular to FIG. 1 thereof, the preferred embodiment of the new and improved keyless locking system embodying the principles and concepts of the present invention and generally designated by the reference numeral 10 will be described.

The present invention, the keyless locking system is comprised of a plurality of components. Such components in their broadest context include a housing, a drive train sub-assembly with a motor, a power transfer sub-assembly with an elastomeric component and a C-channel, and a control member to power the motor. Such components are individually configured and correlated with respect to each other so as to attain the desired objectives.

From a specific perspective, the invention of the present application is a keyless locking system 10 for conveniently locking and unlocking an existing deadbolt 12 on an interior surface 14 of a door. The locking and unlocking are from a remote location without modifying the existing deadbolt. The system includes a housing 18 in a generally rectilinear configuration having a planar plate constituting a front wall 20 with an upper edge 22, a lower edge 24, and parallel side edges 26 there between. A peripheral edge 28 extends inwardly from the upper edge 22, lower edge 24, and side edges 26. A rear wall 30 parallel with the front wall 20 is coupled to the peripheral edge 28 forming a chamber 29 there between.

A drive train sub-assembly 34 is within the chamber 29. The drive train sub-assembly 34 has a drive motor 36 with a worm gear 38 rotatable about a horizontal first axis. An intermediate gear 40 is driven by the worm gear 38 about a horizontal second axis perpendicular to and horizontally beneath the horizontal first axis. An upper pulley 41 is rotatable with the intermediate gear. The upper pulley has a peripheral groove 42 with a first diameter. A lower pulley 44 is rotatable about a third axis beneath and parallel with the second axis. The lower pulley 44 has a peripheral groove 46 with a second diameter greater than the first diameter. A belt 43 couples the groove 42 and the groove 46 of the upper pulley 41 and lower pulley 44, respectively.

A power transfer sub-assembly 54 is within the chamber 29. The power transfer sub-assembly 54 includes a recess 56 in the lower pulley 44. Parallel drive arms 50 are laterally spaced within the recess defining a drive chamber 60 between the drive arms. A central aperture 62 is in the drive chamber 60.

The power transfer sub-assembly 54 also includes a C-channel 70 with a central plate 72 and two parallel side plates 74 extending inwardly. The side plates 74 are located to receive the existing deadbolt for locking and unlocking the door. The central plate 72 has an actuator 76 fabricated of an elastomer in a rectangular configuration facing outwardly. A bracket 78 covers a central region of the actuator and attaches the actuator 76 to the central plate 72. The bracket 78 has a sleeve 80 extending outwardly through the central aperture 62 to position the actuator 76 between the drive arms 50 whereby oscillation of the lower pulley 44 and the drive arms 50 will oscillate the C-channel 70 and the existing deadbolt.

A control member 94 is adapted to be in the possession of the user. The control member, in the preferred embodiment, is a proximity sensor adapted to initiate powering of the motor when coming within a fixed distance from the housing. Any of a wide variety of electronic devices may be used as an alternate to the control member.

A supplemental knob 86 extends outwardly of the housing and operatively couples to the C-channel to lock and unlock the existing deadbolt independent of the motor.

Antennas 88 on the control member and on the housing function to facilitate the remote operation of the system.

A plurality of batteries 90 are in the chamber to power the motor.

A plurality of magnets 92 are on the rear face of the housing to removably couple the housing to the interior surface of the door.

Lastly provided is an optional assembly 100 for use with non-metal doors. The optional assembly includes a metal plate 104 with adhesive strips 106 securable to the non-metal door. This provides a recipient surface for removably receiving the magnets of the housing.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. Keyless locking system for a door having an existing rotatable deadbolt, the keyless locking system comprising:

a housing;

a drive train sub-assembly disposed within said housing, said drive train sub-assembly having a motor;

a power transfer sub-assembly disposed within the housing, said power transfer sub-assembly having an actuator made of an elastomeric material and a C-channel shaped element configured for positioning over the existing rotatable deadbolt when said housing is coupled to the door;

wherein said motor is operatively connected to said actuator to rotate said actuator and said actuator is operatively connected to said C-channel shaped element to rotate said C-channel shaped element; and wherein rotational motive force of said motor is transferred from said actuator to said C-channel shaped element.

2. The keyless locking system of claim 1, further comprising a control member adapted to power said motor to rotate said actuator and said C-channel shaped element via said actuator.

3. The keyless locking system of claim 1, further comprising a plurality of magnets for removably coupling said housing to the door.

4. The keyless locking system of claim 1, wherein said power transfer sub-assembly includes a recess in a pulley of said drive train sub-assembly, and wherein said actuator is disposed within said recess.

5. The keyless locking system of claim 1, further comprising:

a supplemental knob extending forward of said housing and operatively coupled to said C-channel shaped element to rotate said C-channel shaped element independent of said motor.

6. A keyless locking system for a door having an existing rotatable deadbolt, the keyless locking system comprising:

a housing coupled to a surface of the door;

a drive train sub-assembly disposed within said housing, said drive train sub-assembly having a motor;

a power transfer sub-assembly disposed within the housing, said power transfer sub-assembly having an actuator made of an elastomeric material and a C-channel shaped element positioned over the existing rotatable deadbolt such that rotation of said C-channel shaped element causes said existing rotatable deadbolt to rotate;

wherein said motor is operatively connected to said actuator to rotate said actuator and said actuator is operatively connected to said C-channel shaped element to rotate said C-channel shaped element;

wherein rotational motive force of said motor is transferred from said actuator to said C-channel shaped element; and a control member adapted to power said motor to rotate said actuator and said C-channel shaped element via said actuator, thereby rotating the existing rotatable deadbolt to lock or unlock the existing rotatable deadbolt.

7. The keyless locking system of claim 6, further comprising a plurality of magnets for removably coupling said housing to the door.

8. The keyless locking system of claim 6, wherein said power transfer sub-assembly includes a recess in a pulley of said drive train sub-assembly, and wherein said actuator is disposed within said recess.

9. The keyless locking system of claim 6, further comprising:

a supplemental knob extending forward of said housing and operatively coupled to said C-channel shaped element to rotate said C-channel shaped element independent of said motor.

* * * * *